US009407008B2

(12) United States Patent
Fourie

(10) Patent No.: US 9,407,008 B2
(45) Date of Patent: Aug. 2, 2016

(54) MULTI-BEAM MULTI-RADIO ANTENNA

(75) Inventor: Andries Petrus Cronje Fourie, Parkview (ZA)

(73) Assignee: POYNTING ANTENNAS (PROPRIETARY) LIMITED, Samrand (ZA)

( * ) Notice: Subject to any disclaimer, the term of this patent is extended or adjusted under 35 U.S.C. 154(b) by 431 days.

(21) Appl. No.: 14/124,277

(22) PCT Filed: Jun. 6, 2012

(86) PCT No.: PCT/IB2012/052849

§ 371 (c)(1), (2), (4) Date: Feb. 20, 2014

(87) PCT Pub. No.: WO2012/168878

PCT Pub. Date: Dec. 13, 2012

(65) Prior Publication Data

US 2014/0159956 A1 Jun. 12, 2014

(30) Foreign Application Priority Data

Jun. 6, 2011 (ZA) ..... 2011/04180

(51) Int. Cl.
*H01Q 3/30* (2006.01)
*H01Q 1/24* (2006.01)
(Continued)

(52) U.S. Cl.
CPC ..... *H01Q 3/30* (2013.01); *H01Q 1/246* (2013.01); *H01Q 1/525* (2013.01); *H01Q 3/2605* (2013.01); *H01Q 25/00* (2013.01)

(58) Field of Classification Search
CPC ..... H01Q 1/12; H01Q 1/22; H01Q 1/24; H01Q 1/241; H01Q 1/246; H01Q 1/52; H01Q 1/521; H01Q 1/525; H01Q 3/26; H01Q 3/2605; H01Q 3/30; H01Q 25/00; H01Q 3/22; H01Q 3/24; H01Q 3/242; H01Q 3/267; H04B 7/02; H04B 7/04; H04B 7/0491
See application file for complete search history.

(56) References Cited

U.S. PATENT DOCUMENTS 4,952,193 A 8/1990 Talwar
5,339,087 A * 8/1994 Minarik ..... H01Q 3/22 342/172

(Continued)

FOREIGN PATENT DOCUMENTS

EP 0 896 383 2/1999
WO WO 99/26441 5/1999

OTHER PUBLICATIONS

International Search Report for PCT/IB2012/052849, mailed Oct. 5, 2012.

(Continued)

*Primary Examiner* — Bernarr Gregory
(74) *Attorney, Agent, or Firm* — Nixon & Vanderhye PC

(57) ABSTRACT

An antenna system (10) comprises a transmitter part (12) comprising n inputs (40.1 to 40.n) to the antenna system, a transmitter part antenna array 18 comprising k radiating elements; a respective beam-forming network (20.1 to 20.n) connected to each of the n inputs with each beam-forming network having a plurality of outputs; and k signal combiners (22.1 to 22.k) each having a plurality of inputs and a respective output. Each output of each beam-forming network is connected to a respective input of each of the signal combiners and the output of each signal combiner is connected via an output stage to a respective one of the k radiating elements. The beam-forming networks are configured such that each of the transmitter part inputs is associated with a respective transmitter part beam (24.1 to 24.n) having a respective beam-width.

14 Claims, 4 Drawing Sheets

(51) Int. Cl.

| | |
|---|---|
| ***H01Q 1/52*** | (2006.01) |
| ***H01Q 3/26*** | (2006.01) |
| ***H01Q 25/00*** | (2006.01) |
| *H01Q 3/00* | (2006.01) |

(56) References Cited

U.S. PATENT DOCUMENTS

| | | | | | |
|---|---|---|---|---|---|
| 5,565,873 | A * | 10/1996 | Dean | H01Q 1/246 | 342/372 |
| 5,576,717 | A * | 11/1996 | Searle | H01Q 1/246 | 342/372 |
| 5,596,329 | A * | 1/1997 | Searle | H01Q 1/246 | 342/372 |
| 5,602,555 | A * | 2/1997 | Searle | H01Q 1/246 | 342/154 |
| 5,666,123 | A * | 9/1997 | Chrystie | H01Q 1/246 | 342/373 |
| 5,771,017 | A * | 6/1998 | Dean | H01Q 1/246 | 342/374 |
| 5,966,094 | A * | 10/1999 | Ward | H01Q 1/246 | 342/373 |
| 5,977,910 | A * | 11/1999 | Matthews | H01Q 3/26 | 342/368 |
| 6,064,338 | A * | 5/2000 | Kobayakawa | H01Q 3/2605 | 342/378 |
| 6,070,090 | A * | 5/2000 | Feuerstein | H01Q 1/246 | 455/560 |
| 6,127,972 | A | 10/2000 | Avidor et al. | | |
| 6,133,868 | A * | 10/2000 | Butler | H01Q 3/267 | 342/165 |
| 6,198,435 | B1 * | 3/2001 | Reudink | H01Q 1/246 | 342/373 |
| 6,226,531 | B1 * | 5/2001 | Holt | H01Q 1/246 | 342/380 |
| 6,463,302 | B1 * | 10/2002 | Kang | H04B 7/0491 | 455/443 |
| 6,504,515 | B1 * | 1/2003 | Holt | H01Q 1/246 | 343/853 |
| 7,064,697 | B2 * | 6/2006 | Taylor | H01Q 1/525 | 341/137 |
| 7,069,053 | B2 * | 6/2006 | Johannisson | H01Q 1/246 | 342/373 |
| 7,664,533 | B2 * | 2/2010 | Logothetis | H01Q 1/246 | 342/368 |
| 2004/0146237 | A1 | 7/2004 | Taylor et al. | | |
| 2005/0101352 | A1 | 5/2005 | Logothetis et al. | | |

OTHER PUBLICATIONS

Written Opinion of the International Searching Authority for PCT/IB2012/052849, mailed Oct. 5, 2012.

Written Opinion of the International Preliminary Examining Authority for PCT/IB2012/052849, mailed Jun. 12, 2013.

International Preliminary Report on Patentability for PCT/IB2012/052849, mailed Sep. 6, 2013.

* cited by examiner

MULTI-BEAM MULTI-RADIO ANTENNA

This application is the U.S. national phase of International Application No. PCT/IB2012/052849 filed 6 Jun. 2012 which designated the U.S. and claims priority to South African Patent Application No. 2011/04180 filed 6 Jun. 2011, the entire contents of each of which are hereby incorporated by reference.

INTRODUCTION AND BACKGROUND

This invention relates to an antenna system and more particularly to an antenna system suitable for point-to-multi-point communication and an associated method.

Point-to-multi-point communications in fixed and cellular networks typically involve base stations comprising single or sectorized antennas serving many clients with telecommunication services such as data, voice and multi-media. These services suffer from a number of problems, mainly capacity constraints. Capacity may be increased in various ways, such as creating multiple sectors around a base station and/or increasing the number of frequency channels available. The latter has real limitations since frequency spectrum, especially for high-speed data, which is associated with more bandwidth, is not readily available. With the former and when more sectors are created, more frequencies are also typically required, since frequency interference prevents frequencies to be reused in sectors on the base station. Alternatively, capacity may be increased by creating more cells (base stations), each with a smaller coverage area, but this is expensive due to the infrastructure required. Further, an omni-directional antenna or sector antenna often does not provide sufficient gain to users in its beam, since antenna beam-width is inversely related to antenna gain and hence signal strength. Antenna gain may be increased by reducing the angular size of the sectors, but costs, practical constraints, such as number and size of antennas, frequency planning and other technical issues make it impractical to use sectors smaller than about 120 degrees (3 sectors per base station) or 90 degrees (4 sectors per base station).

OBJECT OF THE INVENTION

Accordingly, it is an object of the present invention to provide an alternative antenna system and method with which the applicant believes the disadvantages of the known systems may at least be alleviated or which may provide a useful alternative for the known systems.

SUMMARY OF THE INVENTION

According to the invention there is provided an antenna system comprising a transmitter part comprising:

- n inputs to the antenna system;
- a transmitter part antenna array comprising k radiating elements;
- a respective beam-forming network connected to each of the n inputs, each beam-forming network having a plurality of outputs; and
- k signal combiners each having a plurality of inputs and a respective output wherein
  - each output of each beam-forming network is connected to a respective input of each of the k signal combiners;
  - the output of each signal combiner is connected via an output stage to a respective one of the k radiating elements; and
  - the beam-forming networks are configured such that each antenna system input is associated with a respective transmitter part beam having a respective beam-width.

The first part beams may be arranged collectively to cover at least part of a larger coverage solid angle. The coverage solid angle may have any suitable shape and may, for example be in the form of a sector. The sector may be 90 degrees or larger.

Each beam-forming network may comprise k outputs and each signal combiner may comprise n inputs, each output of each of the beam-forming networks may be connected to a respective input of a respective signal combiner.

The value of k may be different to the value of n, alternatively the respective values may be the same.

A transmitter part signal amplifier may be provided in at least some of the output stages between at least some of the outputs of the k signal combiners and the respective radiating element.

The antenna system may further comprise a receiver part comprising:

- n receiver part outputs;
- a receiver part antenna array comprising k radiating elements;
- k signal splitters, each signal splitter comprising one input and a plurality of outputs; and
- n beam-forming networks, each beam-forming network comprising a plurality of inputs and one output wherein
  - the output of each beam-forming network is connected to a respective one of the n receiver part outputs;
  - each output of each signal splitter is connected to a respective input of each of the beam-forming networks; and
  - the beam-forming networks are configured such that each receiver part output is associated with a respective receiver part beam and such that at least some of the receiver part beams at least partially coincides with an associated transmitter part beam of the transmitter part of the antenna system.

The receiver part may comprise a noise cancellation module. In this specification, unless otherwise appearing from the context, "noise" refers to a small amount of signal originating from the transmitter part, which couples to the receiver part and which interferes with signals received from outside the system.

The noise cancellation module may be connected to the inputs of at least some of the signal splitter circuits.

The receiver part may also comprise a receiver part signal amplifier between the noise cancellation module and the input of the signal splitter circuit.

The noise cancellation module may comprise k noise cancellation circuits, each noise cancellation circuit comprising k inputs and an output. The k inputs being connected to signal coupling means associated with at least some of the transmitter part output stages. Preferably, there is provided k signal couplers each associated with a respective output stage of the transmitter part.

The k inputs of each noise cancellation circuit may be connected via a respective limb or path to a respective input of a signal combiner of the noise cancelling circuit, which provides an output of the noise cancellation circuit. Each path may comprise at least one of a signal phase adjusting means and a signal amplifier or attenuator, to adjust the amplitude of an interfering signal. At least one of the phase adjustment and gain may be fixed. In other embodiments, at least one of the phase adjustment and gain may be variable or adjustable. The adjustment may be made either manually or automatically and/or adaptively.

The output of each noise cancellation circuit may be connected to a first input of a combiner circuit and a second input may be connected to the associated receiver part radiating element. An output of the combiner may be connected to an input of the receiver part amplifier.

Each noise cancellation circuit may be configured to produce for a signal coupled from the transmitter part output stages to the respective receiver part radiating element, an opposing vector, thereby to cancel unwanted noise in the signal received via the receiver part radiating element.

The noise cancellation circuits may allow for the phase and amplitude to be adjusted for each of the coupled signals to allow for maintaining low interference with changes in coupling between transmitter part radiating elements and receiver part radiating elements due to age, weather and/or any other reasons.

In some embodiments, the transmitter part antenna array may also serve as receiver part antenna array.

In other embodiments the transmitter part antenna array may be an array other than the receiver part antenna array. The transmitter part antenna array may be mounted in one of: in juxtaposition with, above and below the receiver part antenna array.

In yet other embodiments the radiating elements of the transmitter part antenna array and the radiating elements of the receiver part antenna array may be interleaved and utilize the same aperture.

The beam-forming networks may comprise means for adjusting beam-forming parameters, such as phase and amplitude, so that beams may be altered to meet system requirements such as capacity, balancing or other parameters.

Also included within the scope of the present invention is a method of transmitting and receiving signals, comprising the steps of:

- for each of a plurality of signal inputs, forming a respective associated transmit beam having a beam-width of less than a total coverage solid angle serviced;
- causing the transmit beams collectively to cover the coverage solid angle;
- for each of a plurality of signal outputs, forming a respective receive beam, which at least partially coincides with an associated transmit beam;
- connecting at least one signal transmitter to each input to transmit a respective transmit signal in the associated transmit beam; and
- utilizing at least one receiver connected to at least some of the outputs to receive signals in the associated receive beam.

The beam-width may be less than 90 degrees, alternatively less than 45 degrees, preferably less than 30 degrees, more preferably less than 25 degrees and most preferably about 20 degrees when used to cover a sector. For more general coverage areas other than sectors, the solid beam angle of each beam may be two times smaller than the overall solid angle requiring coverage, preferably three times smaller and most preferably more than five times smaller than the overall solid angle requiring coverage.

The method may comprise the step of using one transmit carrier frequency in at least two beams.

The method may comprise the step of coupling signals fed to the transmitter part radiating elements and processing the coupled signals to cancel noise in the signals in the associated receive beams, before the signals are fed to the at least one receiver.

The system may allow for use of a narrow band tone or other suitable pilot signal in each transmit signal where such pilot signal can be measured at the receivers adaptively to adjust parameters of noise cancellation circuits.

In other forms of the method, noise cancellation may not be necessary, if different transmit and receive frequency bands or other well known separation techniques are used.

BRIEF DESCRIPTION OF THE ACCOMPANYING DIAGRAMS

The invention will now further be described, by way of example only, with reference to the accompanying diagrams wherein.

DESCRIPTION OF A PREFERRED EMBODIMENT OF THE INVENTION

Figure 1:
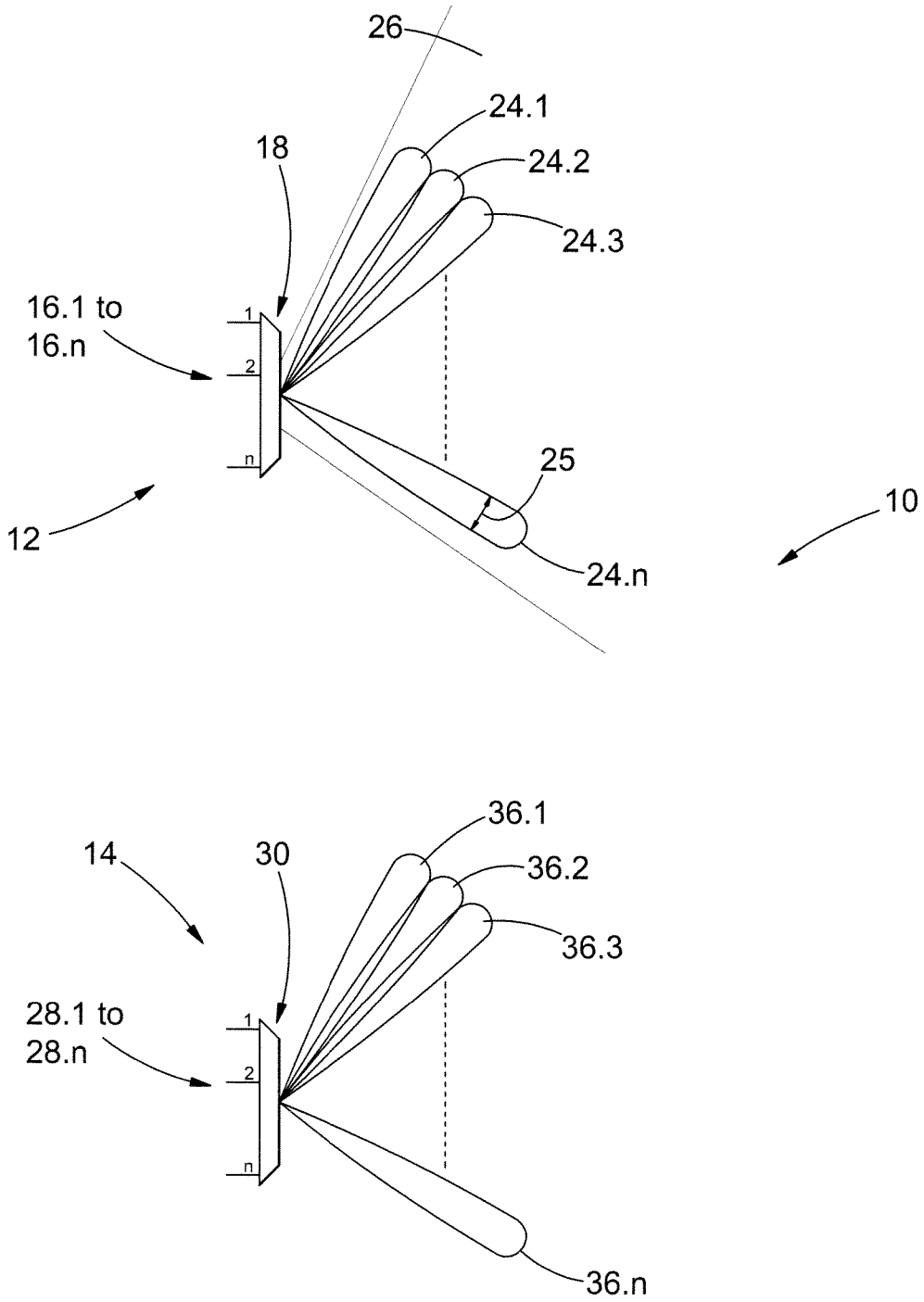
FIG. 1 is a high level diagrammatic representation in plan of an antenna system comprising a plurality of inputs, a plurality of outputs and beams associated with the inputs and outputs.
Figure 2:
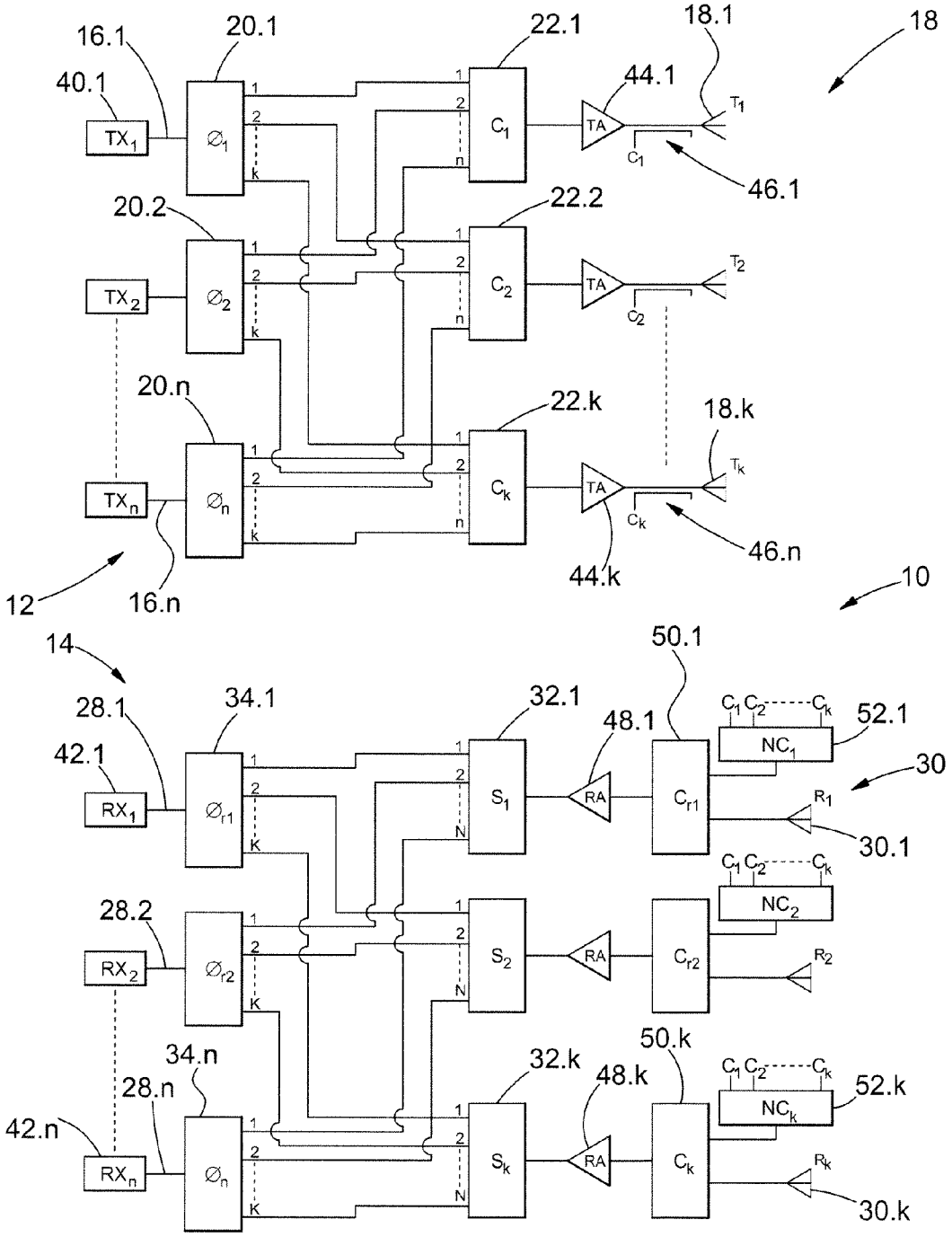
FIG. 2 is a block diagram of an example embodiment of the antenna system comprising a transmitter part and a receiver part.

An antenna system 10 is shown in FIGS. 1 and 2.

The antenna system 10 comprises a first or transmitter part 12 and a second or receiver part 14. The transmitter 12 comprises n inputs 16.1 to 16.n to the antenna system. The transmitter part further comprises an array 18 of k transmitter part radiating elements 18.1 to 18.k, as shown in FIG. 2. Each of the n inputs is connected to a respective beam-forming network 20.1 20.n and each beam forming network is connected to each of k signal combiners 22.1 to 22.k. Each signal combiner 22.1 to 22.k is connected to a respective one of the k radiating elements 18.1 to 18.k. The beam-forming networks are configured such that each input 16.1 to 16.n is associated with a respective transmitter part beam 24.1 to 24.n, having a respective beam-width 25. The transmitter part beams 24.1 to 24.n are arranged, collectively to cover at least part of a sector 26.

The receiver part 14 comprises n outputs 28.1 to 28.n. The receiver part further comprises an array 30 of k receiver part radiating elements 30.1 to 30.k (shown in FIG. 2). The receiver part comprises k signal splitters 32.1 to 32.k and n beam-forming networks 34.1 to 34.n between the radiating elements and the outputs. The beam-forming networks are configured such that each output 28.1 to 28.n is associated with a respective receiver part beam 36.1 to 36.n. At least some of the receiver part beams 36.1 to 36.n at least partially, but preferably substantially, coincide with an associated transmitter part beam 24.1 to 24.n of the transmitter part of the antenna system.

The two parts 12, 14 may be mounted in juxtaposition as shown in the plan view of FIG. 1, but preferably is mounted one part 12, 14 above the other part 14, 12. The inputs 16.1 to 16.n may be used for applying transmission signals. Each input 16.1 to 16.n may be connected to a respective transmitting device 40.1 to 40.n. More than one transmitting device may be connected to an input if they operate on different frequencies or employ other signal separation methods, which are well known in the art. Similarly, each of the outputs 28.1 to 28.n may be connected to one or more respective receiving device 42.1 to 42.n.

Each transmitter part input 16.1 to 16.n is associated with a specific transmitter part beam 24.1 to 24.n. In other words, a signal(s) which is fed to input 16.1 is radiated in space according to the pattern indicated by beam 24.1 and a signal(s) which is fed to port 16.2 is radiated in space according to the pattern indicated by beam 24.2 etc. In the example embodiment shown, the beams 24.1 to 24.n are simply adjacent in the azimuth space, but in other implementations, the beams may be separated both in azimuth and elevation, to form a number of "spot" beams. In a general sense, a number of smaller beams are formed to cover a larger coverage solid angle, which may have any suitable shape as required, to provide desired coverage to an area requiring communication services.

In the example embodiment, the receiver part antenna array 30 is similar to the transmitter part antenna array 18, such that beams 36.1 to 36.n are substantially similar beams and coinciding with beams 24.1 to 24.n, respectively.

Reference is now made to FIG. 2. Each beam-forming network 20.1 to 20.n produces k signals (1 . . . k) of which the phase and amplitude are adjusted by the beam-forming network, such that the k signals form the specific beams 24.1 to 24.n for each input 16.1 to 16.n when linked to the k array elements 18.1 to 18.k. The k signals of each beam-forming network are interlinked to n inputs of each of the k signal combiners 22.1 to 22.k as shown in FIG. 2. The single output of each signal combiner 22.1 to 22.k is connected to an input of a respective transmitter part amplifier 44.1. to 44.k and the outputs of the amplifiers 44.1 to 44.k are connected in output stages to the radiating elements 18.1 to 18.k, respectively. The aforementioned amplifier between the output of the signal combiner and the transmitter part radiating element has sufficient gain to ensure the desired output power level required for system operation, and at least enough to overcome losses in the aforementioned beam-forming and signal combining networks. Using these principles, each of the transmitter part inputs 16.1 to 16.n is associated with a respective transmitter part beam 24.1 to 24.n as aforesaid. In the aforementioned output stages and at or near each array element 18.1 to 18.n, there is provided a respective coupling mechanism 46.1 to 46.n, in order to create at least a fractional copy of each of the signals transmitted by the array elements 18.1 to 18.n.

Still with reference to FIG. 2, each receiver part radiating element 30.1 to 30.k is preferably linked to a respective receiver part amplifier 48.1 to 48.k via a respective signal combiner 50.1 to 50.k. Each combiner 50.1 to 50.k adds to a signal received via the respective receiver part radiating element 30.1 to 30.k a respective noise cancelling signal originating from a respective one of k noise cancelling circuits 52.1 to 52.k forming part of a noise cancellation module 52, before applying the resulting combination to the input of the amplifiers 48.1 to 48.k respectively. The respective noise cancelling signal comprises a conditioned copy of the signals applied to each of the k transmitter part radiating elements 18.1 to 18.k and derived from the coupling mechanisms 46.1 to 46.n. The conditioning may comprise attenuation and/or phase shifting of each signal fed to the transmitter part array elements 18, such that for each transmitted signal, there is created an opposing and cancelling vector which couples to the respective receiver part radiating element from that specific transmitter part radiating element. Each noise cancelling signal is hence the vector sum of the conditioned copies of the k signals applied to the transmit array 18, with phase and amplitude adjusted to cancel the k signals coupled by each transmitter part radiating element 18.1 to 18.k to that specific receiver part radiating element. After the receiver part amplifier, each signal is split into n copies by the k signal splitters 32.1 to 32.k which are then applied to the n beam-forming networks 34.1 to 34.n, each having k inputs, which networks perform the reverse beam-forming operation, such that beams 24.1 to 24.n overlap or coincide with beams 36.1 to 36.n, respectively.

Figure 3:
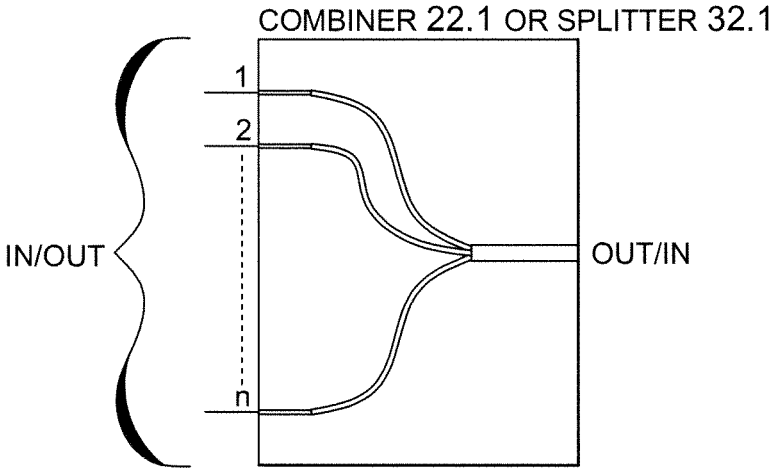
FIG. 3 is a diagrammatic representation of an example embodiment of a signal splitter or signal combiner forming part of the system in FIG. 2.

In FIG. 3, there is shown a basic signal combiner 22.1 or signal splitter 32.1. In the splitter 32.1, a single input is simply split into n components. In the combiner 22.1, n inputs are combined into a single output. Impedance matching is typically performed on one or either sides, to ensure that the combination/splitting occurs without mismatch. It may also be desirable to use Wilkenson splitters, to ensure the branch splits are equal.

Figure 4:
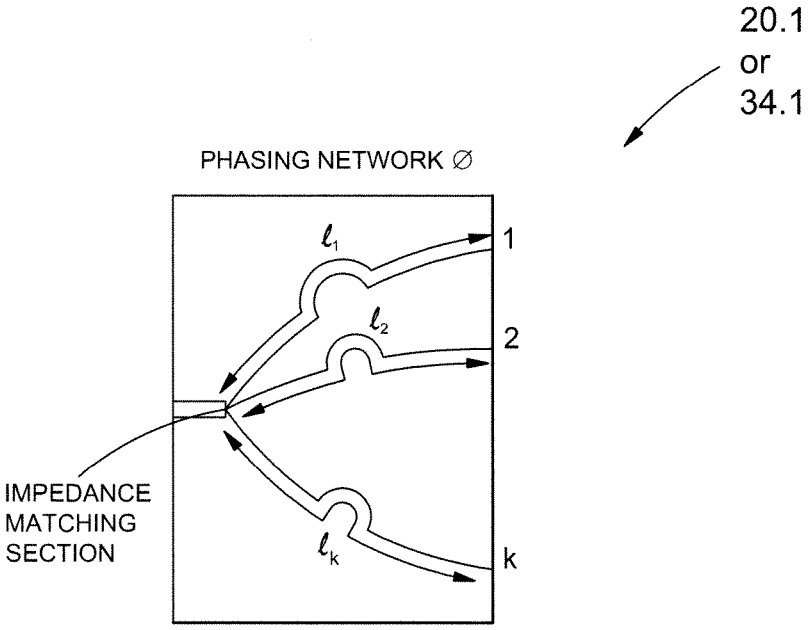
FIG. 4 is a diagrammatic representation of an example embodiment of a beam-forming network forming part of the system in FIG. 2.

In FIG. 4 there is shown a basic form of a beam-forming network 20.1 or 34.1. The beam-forming network shown, may be used in the transmitter part 12 for transmission, where a single port on the left-hand side ("LHS") is used as input and k output signals are produced on the right-hand side ("RHS") and it may be used in the second part 14 for reception, where k RHS ports are inputs and a single LHS port is an output. In a basic form of the beam-forming network, it may be assumed that no magnitude adjustment is required and that only relative phase delays (ϕ1-ϕn) are required for beam-forming. This may be achieved by routing the signals through different path lengths $l_1$ to $l_k$. It should be noted that implementations which alternatively or in addition modify the amplitude of each signal after or before the split may be realized using passive or active means, which gives more flexibility to the beam-forming. Other well known devices and circuits exist which could cause the required phase changes, instead of the simple path delay method shown in this example embodiment.

Figure 5:
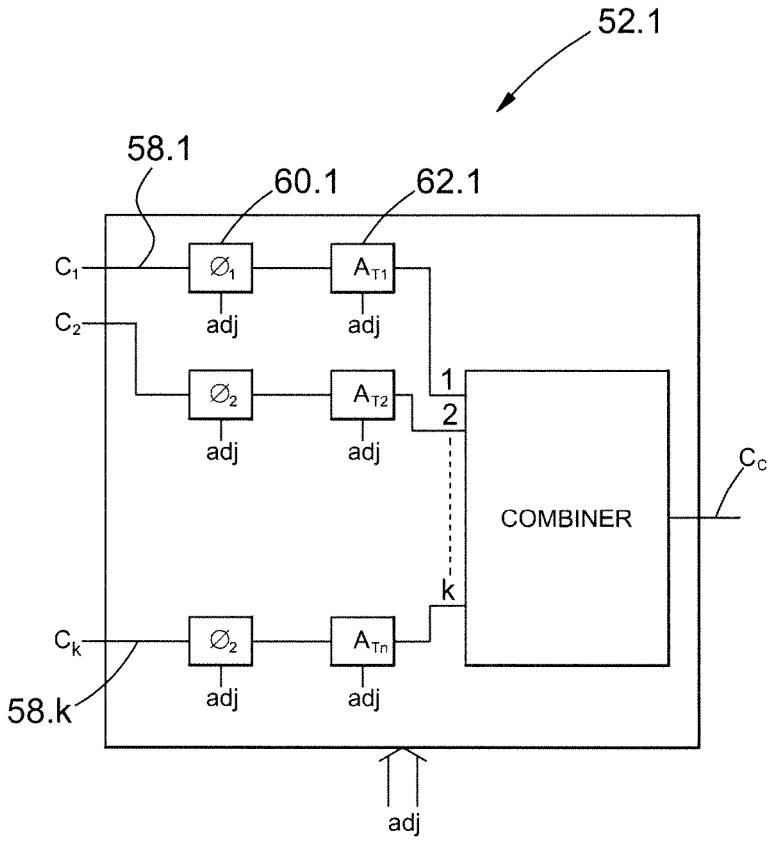
FIG. 5 is a diagrammatic representation of an example embodiment of a noise cancellation circuit forming part of the system in FIG. 2.

The noise cancelling circuits 52.1 to 52.n are similar in configuration and therefore the circuit 52.1 only, will be described in further detail hereinafter with reference to FIG. 5. The circuit comprises k inputs for the signals C1 to Ck coupled by couplers 46.1 to 46.k shown in FIG. 2. Each coupled signal is passed through a respective path 58.1 to 58.k, which, in the case of path 58.1 alters at least one of the coupled signal's phase at 60.1 and its amplitude at 62.1. More particularly, the phase and/or magnitude of each coupled signal is adjusted such that they combine into a noise cancellation signal Cc having a suitable amplitude and a phase opposite to an interference signal which may be received by a specific receiver part radiating element 30.1 from all of the transmitter part radiating elements 18.1 to 18.k. This cancellation will ensure that whatever signal is received by each receiver part radiating element 30.1 to 30.k from any and all of the transmitter part radiating elements 18.1 to 18.k is summed to zero, so that signals originating outside of the system 10 may be received, without interference from the transmitter part signals.

Although in the example embodiment described, the transmitter part antenna array 18 and the receiver part antenna array 30 are described as separate arrays, it should be noted that these can be housed in the same housing with the receiver part elements spaced apart from the transmitter part elements to reduce coupling between transmitted and received signals. The elements of the transmitter part array 18 and the receiver part array 30 may be interleaved with each other to use the same aperture. In still other embodiments the same elements 18.1 to 18.k may be serve as both transmitter part elements and receiver part elements, using well known engineering principles. The proximity between transmitter part and receiver part antenna elements will depend on the quality of the noise cancelling system, but does not affect the general principles of the invention.

It should also be recognized that the invention can be used in Multi-input Multi-Output ("MIMO"), polarization and space diverse systems and other systems where more than one transmit antenna array or more than one receive antenna array are required for system operation.

It should also be noted that components of the system 10 described separately may be combined into units performing the same function. The noise cancelling circuits, signal combiner and amplifier, for example, could be realized in a single device.

Hence, the antenna system 10 allows multiple narrow beams 24.1 to 24.n to be radiated from the same antenna array 18 with one or more transceivers connected to each beam. In principle, the system 10 allows all transceivers to transmit and receive simultaneously on the same frequency, although, in practice, it is likely that adjacent beams will use different frequencies to prevent frequency interference at remote client units. For example, it may be possible to use just two frequencies and alternate them over say 18 sectors, which is currently not practical. It is believed that this may have the following advantages. The antenna gain per beam is much higher than the gain over a sector, roughly by a factor which is equal to the number of beams within the sector. Capacity may be increased, since fewer users are serviced per beam compared to per sector. Spectral efficiency may be increased since the same frequency may be re-used within one antenna array. Capacity is increased for clients, since well known data modulation will allow faster data rates with increased signal strength. Noise interference at a base station is reduced since each transceiver has a much narrower beam through which noise can enter the receiver. The system requires separate transmitter and receiver parts if the same frequency is used for transmit and receiving signals, although the system may also allow the same antenna array to be used for both transmit and receive, if noise cancelling methods are sufficient to achieve low enough noise or transmitter signal interference levels.

The invention claimed is:

1. An antenna system comprising a) a transmitter part comprising:

n inputs to the antenna system;

a transmitter part antenna array comprising k radiating elements;

a respective beam-forming network connected to each of the n inputs, each beam-forming network having a plurality of outputs; and k signal combiners each having a plurality of inputs and a respective output wherein each output of each beam-forming network is connected to a respective input of each of the k signal combiners;

the output of each signal combiner is connected via an output stage to a respective one of the k radiating elements; and the beam-forming networks are configured such that each antenna system input is associated with a respective transmitter part beam having a respective beam-width; and b) a receiver part comprising:

n receiver part outputs;

a receiver part antenna array comprising k radiating elements;

k signal splitters, each signal splitter comprising one input and a plurality of outputs; and n beam-forming networks, each beam-forming network comprising a plurality of inputs and one output wherein the output of each beam-forming network is connected to a respective one of the n receiver part outputs;

each output of each signal splitter is connected to a respective input of each of the beam-forming networks; and the beam-forming networks are configured such that each receiver part output is associated with a respective receiver part beam and such that at least some of the receiver part beams at least partially coincides with an associated transmitter part beam of the transmitter part of the antenna system characterized in that the receiver part comprises a noise cancellation module and wherein the noise cancellation module is connected to the inputs of at least some of the signal splitters and in that the noise cancellation module comprises k noise cancellation, wherein each noise cancellation circuit comprises k inputs and an output, wherein the k inputs are connected to signal coupling means respectively associated with the output stages of the transmitter part to couple to each of the noise cancellation circuits at least a fractional copy $C_1$ to $C_K$ of each of the k signals transmitted by the transmitter part radiating elements.

2. An antenna system as claimed in claim 1 wherein each noise cancellation circuit is configured to adjust the fractional copies $C_1$ to $C_k$ to produce for a signal coupled from the transmitter part antenna array to the respective receiver part radiating element, an opposing vector $C_c$, thereby to cancel unwanted noise in a signal received via the receiver part radiating element.

3. An antenna system as claimed in claim 1 in each of the noise cancellation circuits the k inputs are connected via a respective path to a respective input of a signal combiner of the noise cancellation circuit, which signal combiner provides the output of the noise cancellation circuit and wherein each path comprises at least one of a signal phase adjusting means, a signal amplifier and a signal attenuator.

4. An antenna system as claimed in 3 wherein the output of each noise cancellation circuit is connected to a first input of a respective combiner circuit, wherein a second input of the respective combiner circuit is connected to an associated receiver part radiating element and wherein an output of the combiner circuit is connected to the input of a respective one of the signal splitters.

5. An antenna system as claimed in claim 4 wherein a receiver part amplifier is connected between at least some of the combiner circuit outputs and the input of a respective signal splitter.

6. An antenna system as claimed in claim 1 wherein the transmitter part beams are arranged collectively to cover at least part of a larger coverage solid angle.

7. An antenna system as claimed in claim 1 wherein a transmitter part signal amplifier is provided in at least some of the output stages.

8. An antenna system as claimed in claim 1 wherein the beam-forming networks comprise means for adjusting beam-forming parameters comprising at least one of phase and amplitude, so that at least one of the transmitter part beams and the receiver part beams are adjustable.

9. An antenna system as claimed in claim 1 wherein the transmitter part antenna array also serves as receiver part antenna array.

10. An antenna system as claimed in claim 1 wherein the transmitter part antenna array is an array other than the receiver part antenna array.

11. An antenna system as claimed in claim 10 wherein the transmitter part antenna array is mounted in one of: in juxtaposition with, above and below the receiver part antenna array.

12. An antenna system as claimed in claim 10 wherein the radiating elements of the transmitter part antenna array and the radiating elements of the receiver part antenna array are interleaved and utilize the same aperture.

13. A method of transmitting and receiving signals, comprising the steps of:

for each of a plurality of n signal inputs, forming by means of k signals transmitted by k transmitter part radiating elements a respective associated transmit beam having a beam-width of less than a total coverage solid angle serviced;

causing the transmit beams collectively to cover the coverage solid angle;

for each of a plurality of n signal outputs, forming by means of k receiver part radiating elements a respective receive beam, which at least partially coincides with an associated transmit beam;

connecting at least one signal transmitter to at least some of the inputs to transmit a respective signal transmitter signal in the associated transmit beam;

utilizing at least one receiver connected to at least some of the outputs to receive signals in the associated receive beam and characterized in;

coupling the k signals fed to be transmitted and processing the k coupled signals to cancel noise in the signals in the associated receive beam, before the received signals are fed to the at least one receiver.

14. A method as claimed in claim 13 comprising the step of using one transmit carrier frequency in at least two transmit beams.

* * * * *